US005197898A

United States Patent [19]

Nagamine

[11] Patent Number: 5,197,898

[45] Date of Patent: Mar. 30, 1993

[54] MULTI-CONTACT ELECTRICAL CONNECTOR WITH ONE-PIECE SEAL

[75] Inventor: Akira Nagamine, Kanagawa, Japan

[73] Assignee: AMP Incorporated, Harrisburg, Pa.

[21] Appl. No.: 886,993

[22] Filed: May 21, 1992

[30] Foreign Application Priority Data

Jun. 28, 1991 [JP] Japan ..... 3-158968

[51] Int. Cl.[5] ..... H01R 13/52

[52] U.S. Cl. ..... 439/271; 439/272

[58] Field of Search ..... 439/271-283, 439/587

[56] References Cited

U.S. PATENT DOCUMENTS

| | | | |
|---|---|---|---|
| 4,588,242 | 5/1986 | McDowell | 439/271 |
| 4,940,421 | 7/1990 | Kano et al. | 439/274 |
| 4,946,402 | 8/1990 | Fink et al. | 439/274 |
| 4,950,175 | 8/1990 | Plyer et al. | 439/274 |

FOREIGN PATENT DOCUMENTS 63-102183 2/1988 Japan .

3-43972 3/1991 Japan .

*Primary Examiner*—David L. Pirlot

*Attorney, Agent, or Firm*—Adrian J. LaRue; Timothy J. Aberle

[57] ABSTRACT

A sealing electrical assembly (32) of a type mated with a further connector (11) along a given axis includes first and second housings (1, 2) that telescope together to hold a one-piece seal (3) therebetween. The seal (3) has apertures (10) receiving wires (7) passed through openings (8) in the second housing joining contacts (5) retained in cavities (4) in the first housing and a peripheral surface including ribs (12) engaged by surfaces on a housing (2) of the further connector (11) to be compressed peripherally in a sense transverse to the mating axis of the connectors to effect a seal of the connector interior. One invention embodiment features a seal surface oriented outwardly (12) to be compressed inwardly, and a second embodiment includes a seal surface oriented inwardly (12') to be compressed outwardly against interior surfaces of a second housing to effect a seal of the connector interior.

17 Claims, 3 Drawing Sheets

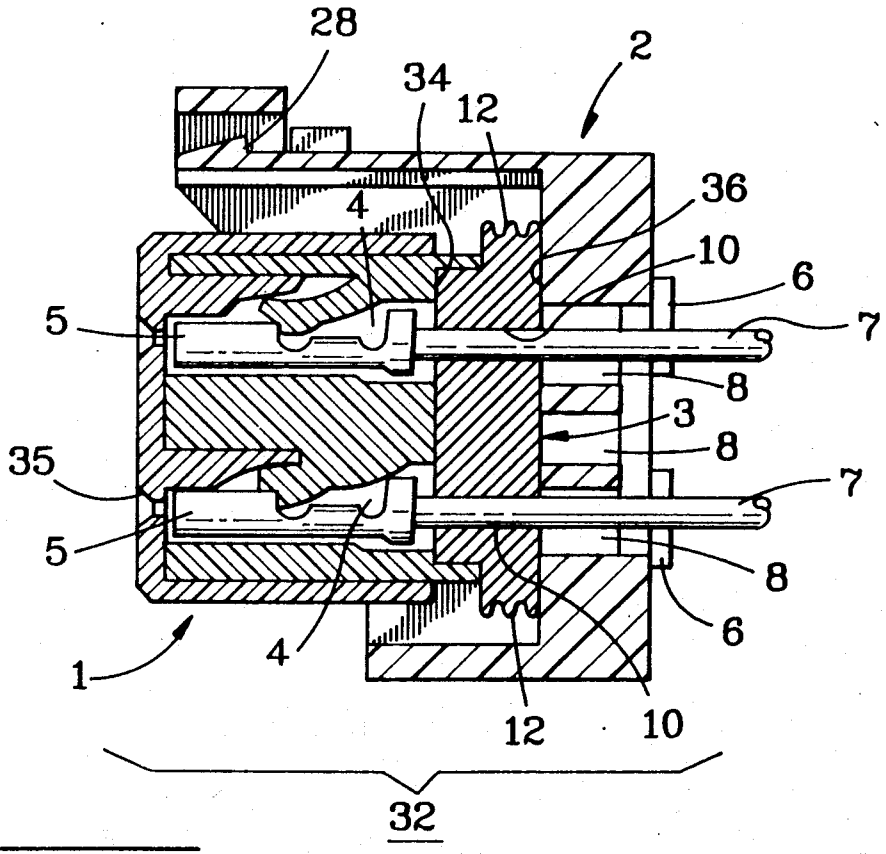
Fig. 2
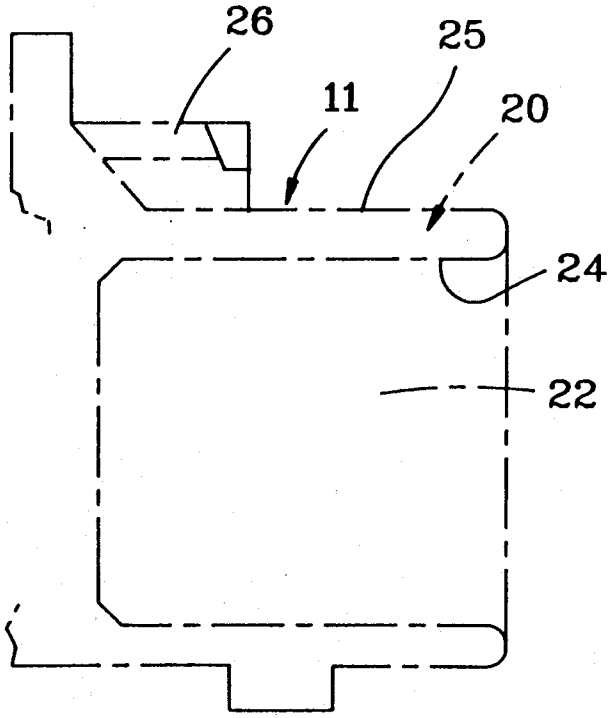

MULTI-CONTACT ELECTRICAL CONNECTOR WITH ONE-PIECE SEAL

FIELD OF THE INVENTION

This invention relates to a multi-contact electrical connector having a seal to prevent moisture or the like from shorting out electrical contacts within the connector housing.

BACKGROUND OF THE INVENTION

An increasing use of electronics within vehicles and craft of all sorts has led to a need for sealing electrical connectors utilized to carry power and signals between components. An example of a conventional sealed or watertight connector that accommodates a plurality of contacts is disclosed in Japanese Utility Model, laid open, Number 102183/'88. In such application, a plurality of sealing members are provided with respect to electrical wires entering the connector to prevent liquid, such as water, from penetrating into the contacts or collecting in the contact-receiving cavities to cause malfunctions. Each wire of the connector has its own individual seal which requires not only assembly labor for each seal, but an opportunity for failure associated with the numbers of seals and contacts. Japanese laid open Patent Number 43972/'91 teaches the use of a single, generally plate-like sealing member having a plurality of openings for accommodating the wires associated with a connector. The seal of this patent, however, is not supported on both sides, and internal pressure within the connector, pressure differentials, can cause the seal to become curved or deformed, or even dislodged, with the result that its sealing characteristics are degraded allowing leakage along wires into the inside of the connector. Strains on the wires themselves can also cause a seal deformation resulting in leakage.

Other types of seals to seal the interior of connectors include gaskets that fit between the mating faces of connectors, the application of sealing material to the rear of a connector, and special containers in which the connector is fitted following assembly.

Each of the foregoing techniques has a certain utility and a certain shortcoming. Accordingly, it is an object of the present invention to provide a novel and improved seal for electrical connectors. It is a further object to provide a one-piece seal hat accommodates multiple wires and at the same time, seals the interior of a connector from moisture on the like entering apart from wire apertures. It is yet a further object to provide a low cost and easily used seal for multi-contact electrical connectors.

SUMMARY OF THE INVENTION

The present invention achieves the foregoing objectives through the provision of first and second housings that telescopically fit together to define an interior cavity with a one-piece seal fitted in such cavity and held against deformation by the housings. The seal has apertures that receive the wires of a cable diameter so as to tightly grip and seal such wires against the ingress of moisture into the interior of the connector. The seal in one embodiment includes around an outside periphery a series of grooves defining surfaces engaged by a mating connector that has a housing of a configuration to fit between the first and second housings of the connector and engage the seal and cause an inward compression of the peripheral surfaces, including the fingers to seal the interior of the connector from moisture finding its way in through the intermating portions thereof. In an alternative embodiment, the seal includes the peripheral surface directed inwardly relative to the mating axis of the connector, the first embodiment having the seal surface and fingers oriented outwardly. The invention contemplates the provision of latches that operate to hold the first and second housings together and further latches that penetrate into recesses within the seal and latch the seal to the two housings.

The first housing of the connector includes cavities that receive contacts attached to the wires that mate with the contacts of the further connector, and the second housing includes openings of a dimension to allow connector contacts and wires to pass therethrough. These openings are positioned in general alignment with the apertures in the seal and serve to reduce strains on the seal caused by the wires due to pulling or bending loads on the cable formed by the wires. Providing a seal in accordance with the invention thus reduces labor in handling numerous seals, improves reliability, and forms the additional function of providing peripheral sealing as well as wire sealing.

BRIEF DESCRIPTION OF THE DRAWINGS

FIG. 2 is a side cross-sectional view of a portion of the connector with the mating connector show partially in phantom.

DETAILED DESCRIPTION OF THE INVENTION

Figure 1:
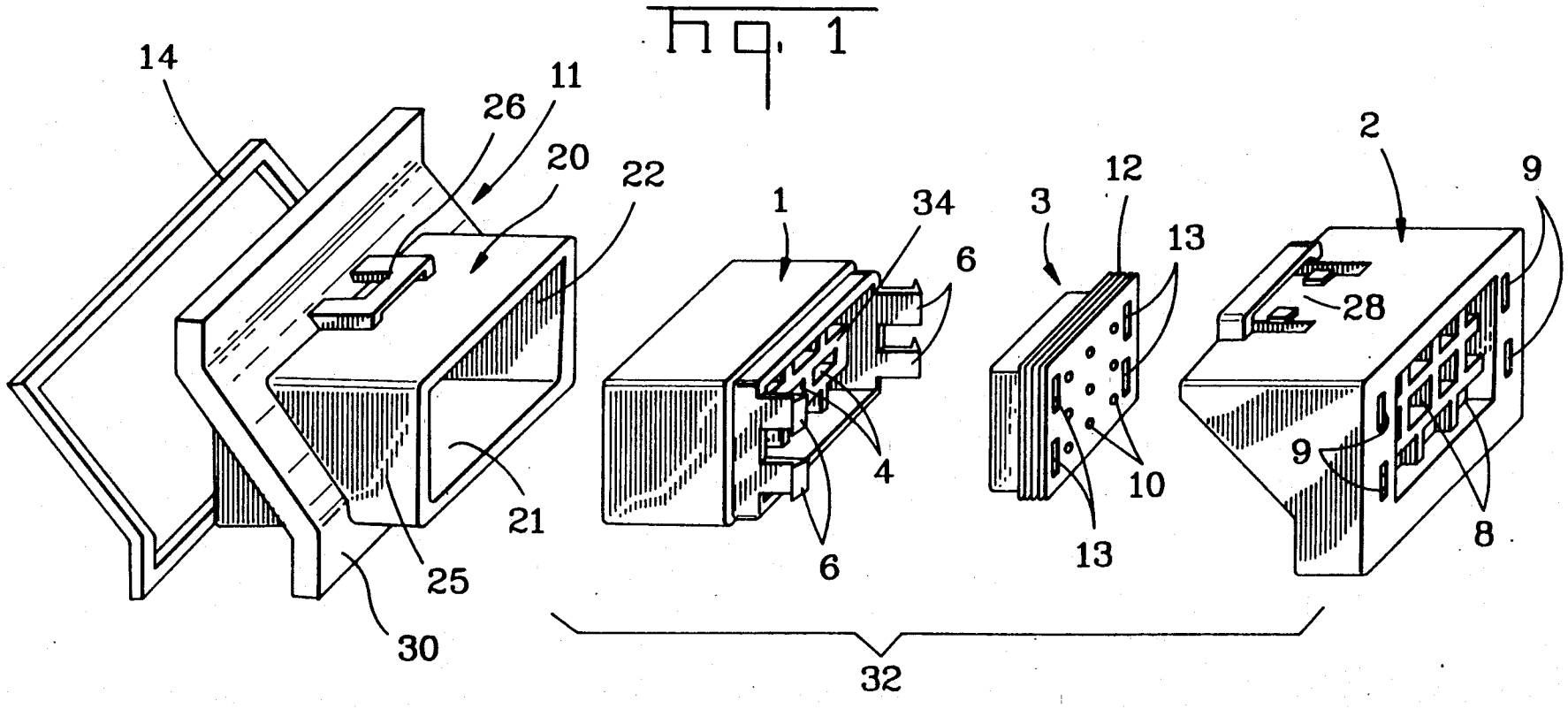
FIG. 1 is a perspective exploded view showing a connector assembly, with individual parts separated for clarity.

Referring now to FIG. 1, a connector assembly 32 is shown to include a first housing 1, a second housing 2, and a unitary seal 3 positioned between housings 1 and 2. These elements are shown separated along the axis of the connector assembly and to the left, a mating connector housing 20 is shown positioned to be engaged by the assembly 32 when assembled. FIG. 2 shows, in a side view, the relationship between the assembly 32 and connector 11.

In FIG. 1 and additionally in FIG. 2, the first housing 1 may be seen to include a series of cavities 4 that receive contacts 5 in the manner shown in FIG. 2, latched within the interior of the housing. Housing 1 also includes a series of latches 6 that extend through apertures 13 in seal 3 and through apertures 9 in the second housing 2, FIG. 2 showing the ends of latches 6 extending through housing 2.

Housing 2 may be seen to include, additionally, apertures 9 through which the wires 7 are extended, referring to, FIG. 2 Beveled apertures 35 are shown in FIG. 2 aligned with contacts 5 to allow penetration of the contacts by contacts mounted in connector, half 11, not shown, that extend through the front face of the connector first housing 1. The first housing includes a rear face 34 which comprises one wall of a recess that receives the front face of seal 3. The second housing 2 includes interiorly a forward face 36 that also engages the near face of the seal. As can be seen in FIGS. 1 and 2, seal 3 includes a plurality of apertures 10 extending therethrough that allow wires 7 to be extended through the seal, apertures 10 having a dimension to tightly grip and seal against moisture of other fluids or liquids following the surface of wire 7 into the connector. Seal 3 has a peripheral surface that includes a series of spaced flexible fingers or projections 12 defining groves therebetween which extend therearound.

The mating or further connector 11 includes a plastic housing 20 having an interior cavity 22 with interior wall surfaces 24 that extend peripherally around the interior of the housing. Housing 20 also includes an exterior surface 25 extended therearound with both of these surfaces having configurations to fit within portions of housing 2 and around portions of housing 1. Housing 20 includes a latch 26 engaged by a mating latch 28 on housing 2, note the disposition of these latches in FIG. 2. As can be seen in FIG. 1, housing 20 includes a flange 30 that typically fits against a bulkhead, having a configuration like that of flange 30. A seal 14 may be employed against flange 30 to seal housing 20 from moisture or the like entering such housing from the front face or panel in which the housing half is fixed. Means such as screws or a bezel may be employed, not shown, to mount housing 20 on a bulkhead or the like.

Referring now to FIG. 2, the positioning of the connector housing 1 and 2 assembled with seal 3 forming assembly 32 is shown in an alignment with the housing 20 of connector 11. Upon mating of the assembly 32 with the connector 11, the wall of the housing, including the interior surface 24, will pass within housing 2 and over housing 1 to a point where the interior surface 24 engages the fingers 12 to compress the seal around its periphery so that moisture cannot enter the interior of the connector along the exterior surfaces 25 of housing 20. As can be appreciated from the showing in FIG. 2, the seal 3 is held, lightly compressed, between surface 34 of housing 1 and surface 36 of housing 2 by action of latches 6 that link the two housings together. This prevents loss of the seal, a common problem with peripheral seals, and at the same time, assures a positioning of the surfaces of apertures 10 relative to wires 7 and a positioning of the fingers 12 around the periphery of the seal relative to the housing of connector 11.

Figure 3:
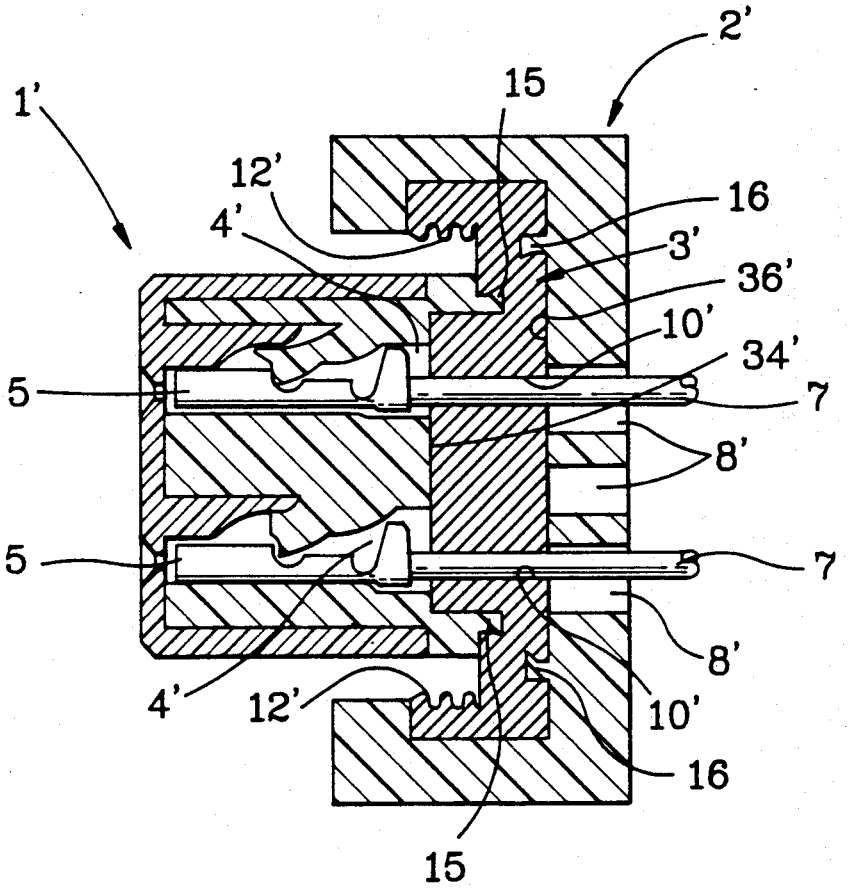
FIG. 3 is a side cross-sectional view of a portion of the connector in an alternative embodiment.

FIG. 3 shows an alternative version of the connector with the various numbered parts as in FIGS. 1 and 2, noting that some of the numerals have primes. Additionally shown in FIG. 3 is the seal 3' having the grooves defined by flexible projection on fingers 12' directed inwardly relative to the mating axis of the customer. Also included are latches 15 and 16 projecting from the first housing 1' and the second housing 2' as indicated in FIG. 3 to engage in recesses in the seal and latch the seal to the housings. These projections and grooves assure that the housings 1' and 2' will remain attached to the seal 3' and to each other.

As can be appreciated, the cavities 8 located generally in alignment with the seal apertures 10' limited bending or displacement of wires 7 relative to the seal and to the housing.

In accordance with the invention, the housings 1, 2 and 20 may be formed with engineering plastic material having suitable dielectric qualities as well as being readily moldable. The seal may be formed of a number of resilient plastic materials including rubber and artificial rubbers that substitute for rubber, a silicon-type material being widely used for this purpose.

Having now described the invention relative to drawings illustrating such, claims are appended and intended to define what is believed inventive.

I claim:

1. A sealed connector matable along a given axis with a further connector comprising a first dielectric housing including a plurality of contact-receiving cavities, the housing having front and rear faces with the cavities opening to said faces, said rear face comprising one wall of a recess in said first housing, a second dielectric housing having a plurality of openings leading to a forward face to receive electric wires terminated to contacts inserted in the cavities of the first housing, the first housing having a peripheral geometry to fit within the second housing, a seal including apertures to receive the wires in a tight sealing engagement with the seal fitted between the first and second housings, the seal having a planar radially inner surface geometry engaged and surrounded by a peripheral wall of said recess to be engaged by the rear face of the first housing and the forward face of the second housing and having a peripheral radially outer geometry to be engaged peripherally by the housing of the further connector extended within the second housing and over the first housing with the seal being compressed transversely to the axis of mating thereby providing a sealing action for the connector.

2. The connector of claim 1, wherein said seal includes a series of the ribs on the peripheral surface thereof compressed by engagement of the surfaces of the further housing to enhance the sealing action.

3. The connector of claim 1, said seal includes an exterior peripheral surface engaged by the housing of the further connector to be compressed inwardly relative to the given axis.

4. The connector of claim 1, wherein said seal includes interior peripheral surfaces engaged by the housing of the further connector to be compressed outwardly relative to the given axis of mating.

5. The connector of claim 1, wherein the rear surface of the first housing and the front surface of the second housing support the seal against unwanted deformation due to internal pressure and/or strains from the wires passed through such seal.

6. The connector of claim 1, wherein said openings in the second housing are generally aligned with the apertures of the seal to reduce stress on the seal caused by bending loads applied through said wires.

7. The connector of claim 1, wherein said seal includes a peripheral surface engaged by an outside surface of the further connector to effect said sealing.

8. The connector of claim 1, wherein means are provided for holding said seal secured to at least one of the first and second housings.

9. The connector of claim 8, wherein said means includes latches on said first housing projecting through apertures on the second housing to latch the two housings together against said seal.

10. The connector of claim 8, wherein said seal includes further apertures and at least one of said first and second housings includes projections that fit within the recesses of the seal to lock the seal to the housing.

11. An electrical connector assembly, comprising: a first dielectric housing having a recess and contact-receiving passageways in which electrical contacts are to be disposed;

a second dielectric housing having holes through which electrical wires connected to the electrical contacts extend;

a sealing member disposed between the first and second housings providing a seal therebetween, said sealing member having an inner end which engages and is surrounded by a peripheral wall of said recess, and apertures through which the electrical wires sealingly extend;

latch means latchably securing said first and second housings together thereby maintaining said housings in sealed engagement with said sealing member; and flexible sealing members extending along an exterior surface of said sealing member for sealing engagement with a housing member of a matable connection.

12. An electrical connector assembly as claimed in claim 11, wherein said latch means include latch members on one of said first and second housings that latchably engage with the other of said first and second housings.

13. An electrical connector assembly as claimed in claim 11, wherein said latch means include latch projections extending from said first and second housings engaging within recesses in said sealing member.

14. An electrical connector assembly as claimed in claim 11, wherein said second housing has a section spaced from and extending along said first housing defining a space in which the housing member of the matable connector is disposed.

15. An electrical connector assembly as claimed in claim 14, wherein said flexible sealing members are directed toward said section of said second housing.

16. An electrical connector assembly as claimed in claim 14, wherein said flexible sealing members are directed toward said first housing.

17. An electrical connector assembly, comprising: a first dielectric housing having contact-receiving passageways in which electrical contacts are to be disposed;

a second dielectric housing having holes through which electrical wires connected to the electrical contacts extend;

a sealing member disposed between the first and second housings providing a seal therebetween, said sealing member having apertures through which the electrical wires sealingly extend;

latch means latchably securing said first and second housings together thereby maintaining said housings in sealed engagement with said sealing member;

flexible sealing members extending along an exterior surface of said sealing member for sealing engagement with a housing member of a matable connection;

said second housing further including a section spaced from and extending along said first housing defining a space in which the housing member of the matable connector is disposed; and wherein said flexible sealing members are directed toward said first housing.

* * * * *